US007854452B2

(12) United States Patent
Nishio et al.

(10) Patent No.: US 7,854,452 B2
(45) Date of Patent: Dec. 21, 2010

(54) ENGAGEMENT FITTING AND MANUFACTURING METHOD OF ENGAGEMENT FITTING

(75) Inventors: Mayuki Nishio, Shizuoka-ken (JP); Shinichi Nishio, Shizuoka-ken (JP); Masayuki Nishio, Shizuoka-ken (JP); Tatsuya Nishio, Shizuoka-ken (JP)

(73) Assignee: Nishio Seimitsu Kabushiki Kaisha, Shizuoka-ken (JP)

( * ) Notice: Subject to any disclaimer, the term of this patent is extended or adjusted under 35 U.S.C. 154(b) by 127 days.

(21) Appl. No.: 12/050,745

(22) Filed: Mar. 18, 2008

(65) Prior Publication Data

US 2008/0231059 A1 Sep. 25, 2008

(30) Foreign Application Priority Data

Mar. 23, 2007 (JP) ..... 2007-75994
May 2, 2007 (JP) ..... 2007-121605
Oct. 2, 2007 (JP) ..... 2007-258968

(51) Int. Cl.
*E05B 15/02* (2006.01)
*E05B 15/00* (2006.01)

(52) U.S. Cl. ..... 292/340; 292/341

(58) Field of Classification Search ..... 292/340, 292/341

See application file for complete search history.

(56) References Cited

U.S. PATENT DOCUMENTS 888,570 A * 5/1908 Zimmerman ..... 292/340
906,358 A * 12/1908 Zimmerman ..... 292/340
1,915,795 A * 6/1933 Macmillan ..... 292/338
2,723,151 A * 11/1955 Seyforth ..... 292/340
3,572,793 A * 3/1971 Cole ..... 292/216
4,305,611 A * 12/1981 Robins ..... 292/238
5,050,917 A * 9/1991 Hamada et al. ..... 292/340
5,716,085 A * 2/1998 Kobayashi ..... 292/340
5,833,024 A * 11/1998 Kaneko ..... 180/69.2
6,108,894 A * 8/2000 Mizuki et al. ..... 29/509
6,672,634 B2 * 1/2004 Burton ..... 292/340
2007/0262595 A1 * 11/2007 Johnson ..... 292/340
2008/0093866 A1 * 4/2008 Bolbocianu et al. ..... 292/340

FOREIGN PATENT DOCUMENTS

EP 1728943 A1 * 12/2006
JP 01223276 A * 9/1989
JP 06-312670 11/1994
JP 06312670 A * 11/1994
JP 2002-337743 11/2002

* cited by examiner

*Primary Examiner*—Carlos Lugo
(74) *Attorney, Agent, or Firm*—Knobbe, Martens, Olson & Bear, LLP

(57) ABSTRACT

An engagement fitting comprises a hook that is integrally formed from a metal rod member. The rod member is bent into a generally U-shaped configuration. Bases then can be bent at approximately right angles at base ends of a pair of legs of the generally U-shaped hook. The bases extend to opposite sides from one another across a plane that is generally defined by the U-shaped configuration. The base is formed at least partially flat and can be provided with attachments such that the engagement fitting can be mounted on other members.

4 Claims, 13 Drawing Sheets

ENGAGEMENT FITTING AND MANUFACTURING METHOD OF ENGAGEMENT FITTING

CROSS-REFERENCE TO RELATED APPLICATIONS

This application claims the prior benefit under 35 USC 119 of Japanese Patent Application No. 2007-75994, filed Mar. 23, 2007, Japanese Patent Application No. 2007-121605, filed May 2, 2007, and Japanese Patent Application No. 2007-258968, filed Oct. 2, 2007, each of which is hereby incorporated by reference in its entirety.

BACKGROUND OF THE INVENTION

1. Field of the Invention

The present invention relates to an engagement fitting used as a locking device striker for an opening-and-closing body (e.g., door) of, for example, a vehicle interior, an engine compartment, a trunk, or the like of an automobile; and a method of manufacturing the engagement fitting.

2. Description of the Related Art

With reference initially to FIGS. 25 and 26, an "engagement fitting" generally is paired with an engagement pawl that is controlled by a device, such as a key and a lever. The engagement fitting can be made by bending into a U-shape a rod (e.g., a steel rod member), the cross-sectional shape of which is either circular or square. The engagement fitting can include an engagement pestle 2 that extends in a horizontal direction and legs 3 that extend from both ends of the engagement pestle 2. The ends of the legs 3 can be coupled to an engagement plate 5 by welding or the like (see JP-REI-H06-312670 and JP-A-2002-337743).

However, in addition to a bending process used to form the engagement pestle 2, processes are required for press-forming the engagement plate 5, which is made of a flat bar or the like, and for welding the engagement pestle 2 to the engagement plate 5. In addition to requiring a number of steps, the manufacturing method requires a number of distinctly different types of processes. Therefore, the manufacturing process is fairly complicated and fairly costly.

To remedy these problems, JP-A-H07-220345 suggested deforming the engagement plate to form the engagement pestle. However, because the engagement pestle is formed of a layer from a couple of board members, the board members have to be joined together, which somewhat complicates the manufacturing method.

SUMMARY OF THE INVENTION

Because the conventional striker comprises multiple parts, the assembling man-hours increase. Moreover, it also is required to strengthen the attachment portions of the multiple parts. Therefore, one aspect of an embodiment of the present invention relates to an engagement fitting that provides sufficient strength while using fewer parts and fewer assembling man-hours. Another aspect of an embodiment of the present invention relates to a method of manufacturing the engagement fitting.

Thus, one aspect of some embodiments of the present invention comprises an engagement fitting. The engagement fitting comprises a hook and a base that are integrally formed with a single metal rod member. The hook comprises a generally u-shaped configuration. The generally u-shaped configuration comprises a pair of spaced legs. The base comprises a pair of base portions that extend at an approximately right angle from a respective base end of the pair of legs. The generally u-shaped hook is positioned between the pair of base portions. The base is generally flat and comprises at least one mounting hole.

BRIEF DESCRIPTION OF THE DRAWINGS

These and other features, aspects and advantages of the present invention will now be described with reference to the drawings of several preferred embodiments, which embodiments are intended to illustrate and not to limit the invention, and in which figures.

DETAILED DESCRIPTION OF THE PREFERRED EMBODIMENTS

With reference now to FIGS. 1-6, a strike plate or engagement fitting 10 is shown. The engagement fitting 10 can be used with an automobile door as an "opening-and-closing body." The illustrated engagement fitting 10 comprises a hook 11 that is integrally shaped from a single metal rod member. The engagement fitting 10 preferably is bent generally in a gate shape (i.e., bent in a generally U-shaped configuration). The engagement fitting 10 also comprises bases 12 that are bent at an approximately right angle at base ends of a pair of legs 11*a* of the generally U-shaped hook 11. The bases 12 preferably extend in opposite directions from one another across a plane that is generally defined by the generally U-shaped hook 11.

The hook 11 comprises a pair of the legs 11*a* and an engagement pestle 11*b* that extends across these legs 11*a*. The engagement pestle 11*b* preferably extends generally parallel with a surface (not shown) of a vehicle body on which the engagement fitting 10 will be mounted.

In addition, the bases 12 are flattened at the tips (or at least partially flattened) and the bases 12 are provided with a pair of attachments 12*a* that can be mounted onto other members (e.g., the mounting surface on the vehicle body), which other members are not shown. The attachments 12*a* preferably are formed into circular shapes by flattening spherical bulges at the ends of the rod member. Bolt holes 12*b* can be drilled at the center of the circular shape that is formed by flattening the spherical bulges.

Because the engagement fitting 10 is fabricated by bending a single material in a desired shape, manufacturing the engagement fitting does not require machining or welding. Therefore, the illustrated configuration simplifies manufacturing engagement fittings. In addition, because manufacturing the illustrated engagement fitting 10 does not produce waste materials, such as chips that might be formed in the shaping process, material yields are improved lower cost manufacturing is possible.

Figure 1:
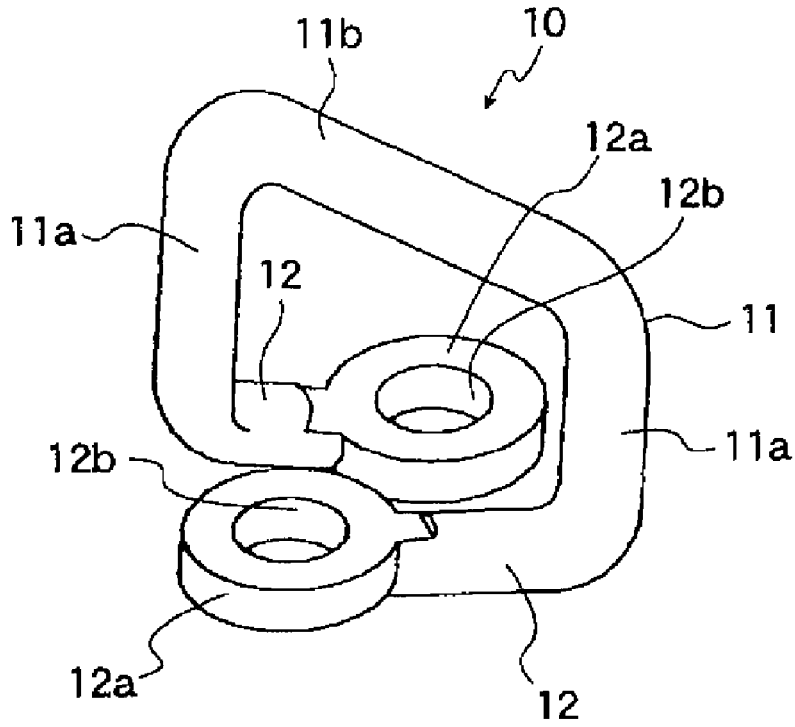
FIG. 1 is a perspective of an engagement fitting that is arranged and configured in accordance with certain features, aspects and advantages of a first embodiment of the present invention.
Figure 2:
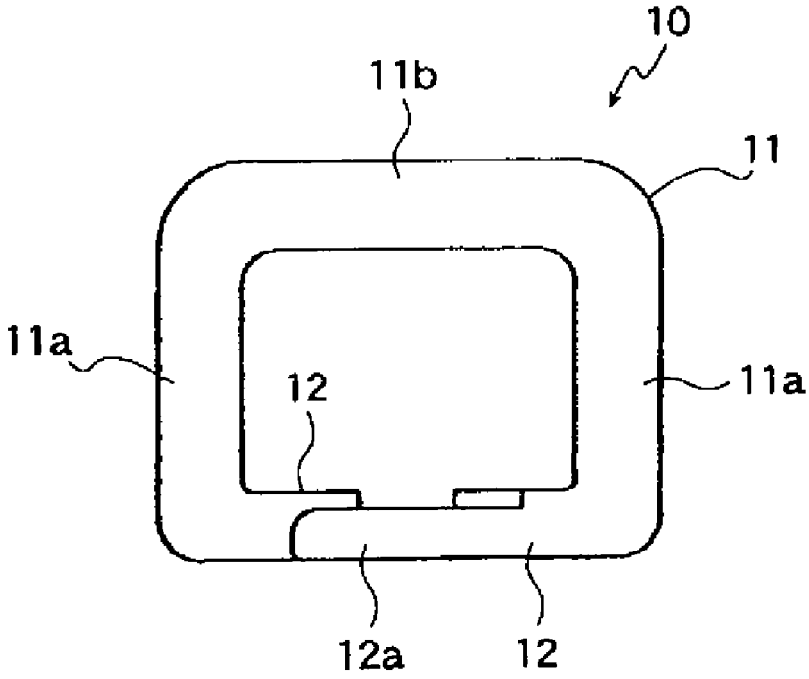
FIG. 2 is a front view of the embodiment shown in FIG. 1.
Figure 3:
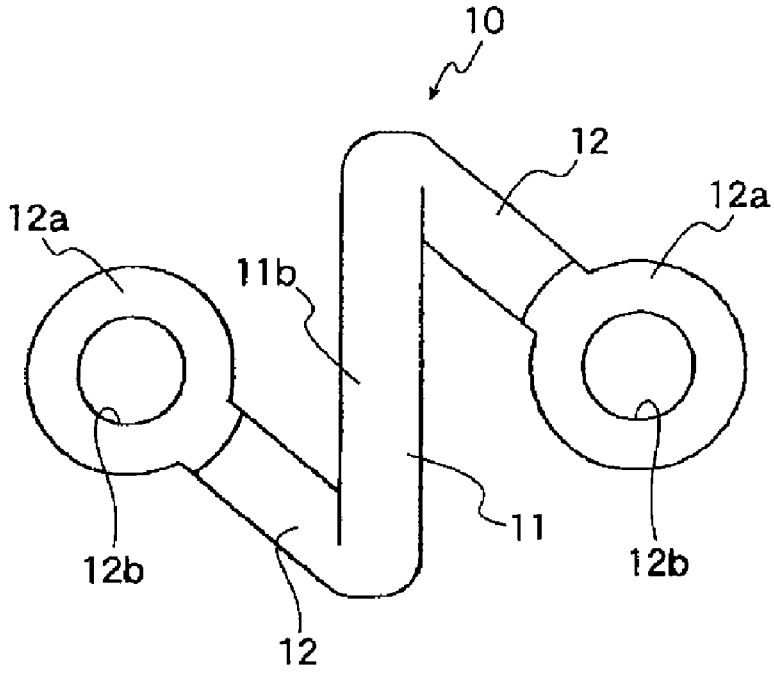
FIG. 3 is a plan view of the embodiment shown in FIG. 1.
Figure 4:
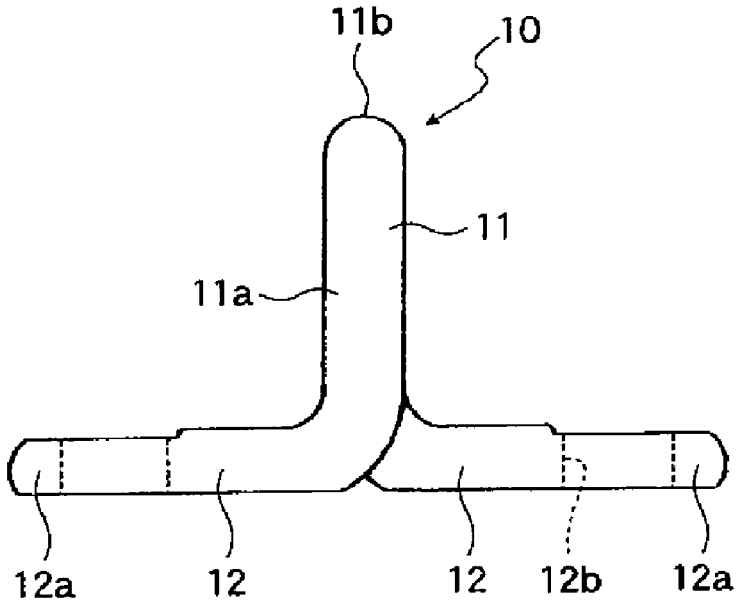
FIG. 4 is a side view of the embodiment shown in FIG. 1.
Figure 5:
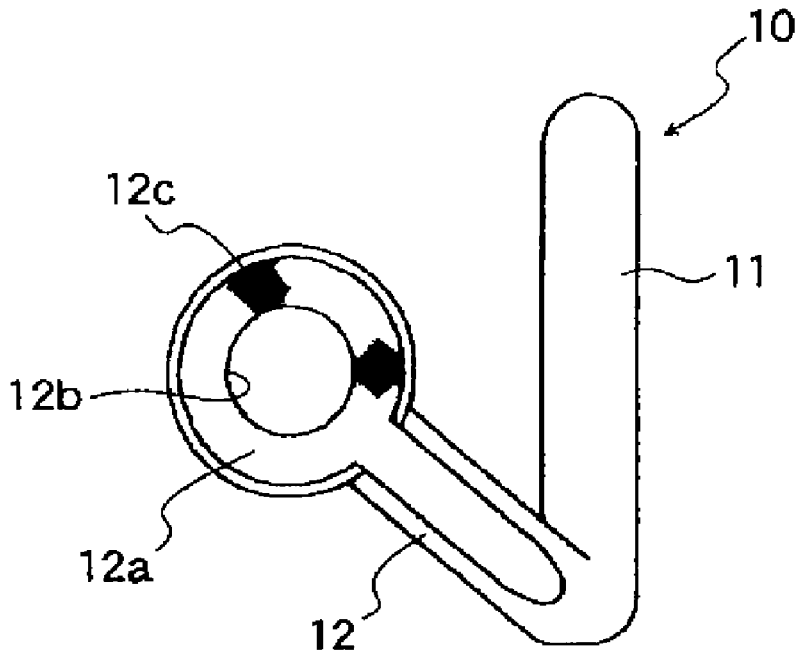
FIG. 5 is a bottom plan view of a portion of the embodiment shown in FIG. 1.
Figure 6:
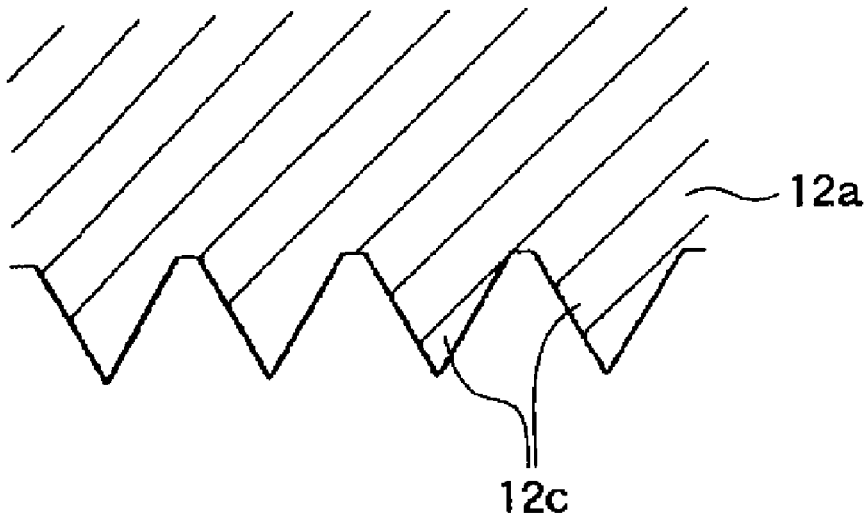
FIG. 6 is a sectional view showing a serrated portion of an engagement plate that is arranged and configured in accordance with certain features, aspects and advantages of an embodiment of the present invention.
Figure 7:
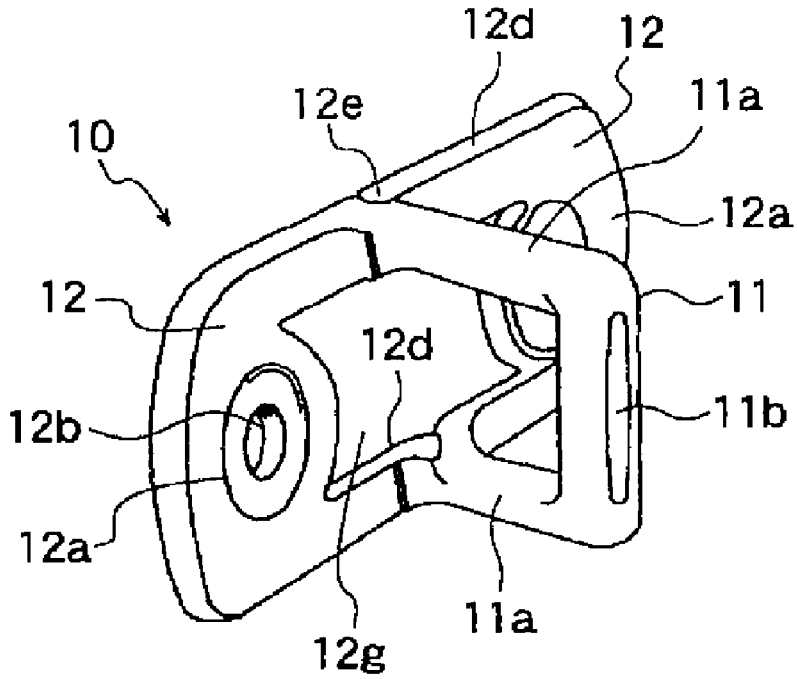
FIG. 7 is a perspective view of an engagement fitting that is arranged and configured in accordance with certain features, aspects and advantages of a second embodiment of the present invention.
Figure 8:
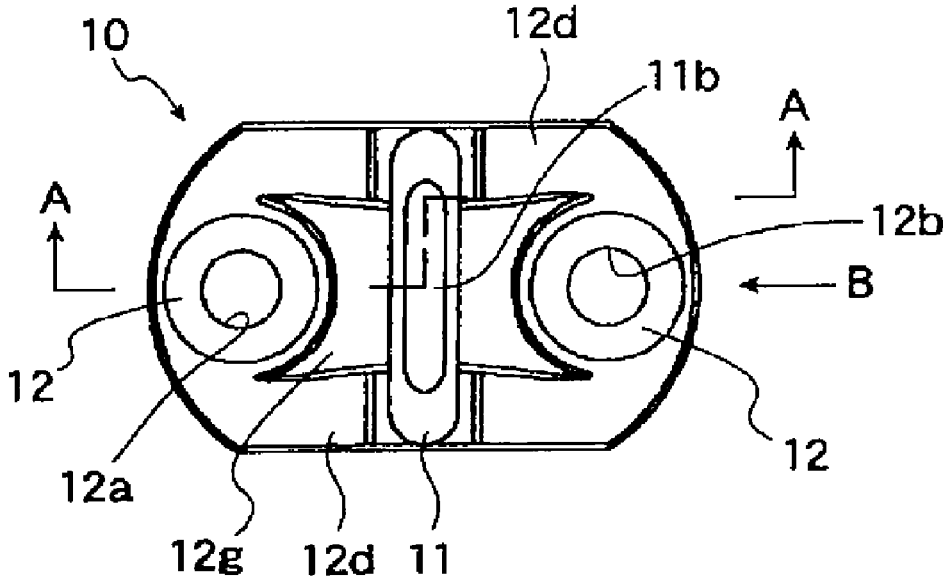
FIG. 8 is a plan view of the embodiment shown in FIG. 7.

With reference to FIG. 6, a serrated, knurled or roughened surface, such as that formed by a myriad of square pyramid projections 12*c* in a mountain shape, can be are provided on the back surface of the attachment 12*a*. In other words, such a surface can be provided to the surface that contacts the surface on which the engagement fitting 10 will be mounted on the vehicle body side.

Therefore, when a bolt (not shown) is passed through the bolt hole 12*b* and tightened into position in a weld nut (not shown), for instance, which can be provided on the surface to which the engagement fitting 10 is being mounted, the tips of the square pyramid projections 12*c* can be crushed while the bolt is being tightened even if the back surface of the attachment 12*a* is not mounted flush with the mounting surface (e.g., the back surface of the attachment 12*a* is at a slight angle to the mounting surface). Accordingly, the entire surface comes into contact without significant modification of the inclination of the attachment 12*a*. Moreover, the surface pressure at the time of tightening stabilizes and the bolt is not likely to be loose.

With reference to FIGS. 7-12, another embodiment of an engagement fitting 10 is shown. The engagement fitting 10 comprises a hook 11 that is integrally formed with a continuing metal rod member and bent generally into a gate shape (e.g., a U-shaped configuration). The illustrated engagement fitting 10 also comprises bases 12 that are extend outward at an approximately right angle at both ends of this gate-shaped hook 11, thus forming base ends of the gate shape. The base ends of the gate shape preferably extend to opposite sides from one another across a plane that is generally defined by the gate shape.

The illustrated hook 11 has a pair of legs 11*a* and an engagement pestle 11*b* extending across the legs 11*a*. Preferably, the engagement pestle 11*b* extends generally parallel with a mounting surface (not shown) upon which the engagement fitting can be mounted.

The illustrated bases 12 preferably are formed in a flattened shape by compression molding. The illustrated bases 12 also can be provided with a pair of attachments 12*a* that can be mounted to other members (e.g., the surface of the vehicle body to which the engagement fitting will be mounted), which other members are not shown. The attachments 12*a* can be formed in a generally circular configuration by flattening spherical bulges 13*b*, such as those shown in FIG. 12. Bolt holes 12*b* can be drilled at the center of the flattened spherical bulges 13*b*.

Figure 9:
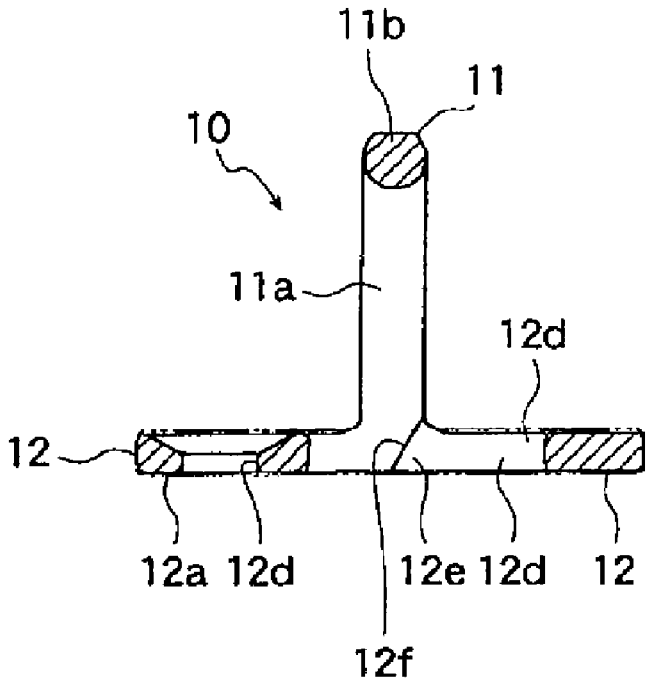
FIG. 9 is a cross sectional view taken along the line A-A in FIG. 8.
Figure 10:
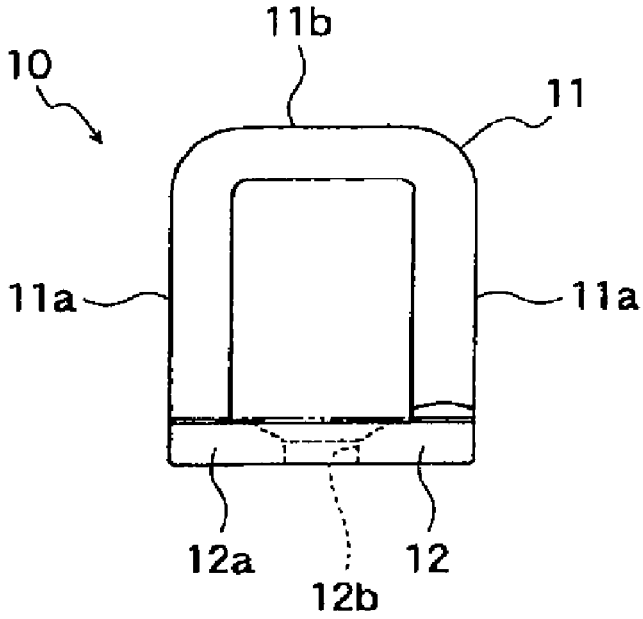
FIG. 10 is a view of the embodiment shown in FIG. 7 as viewed from the arrow B in FIG. 8.
Figure 11:
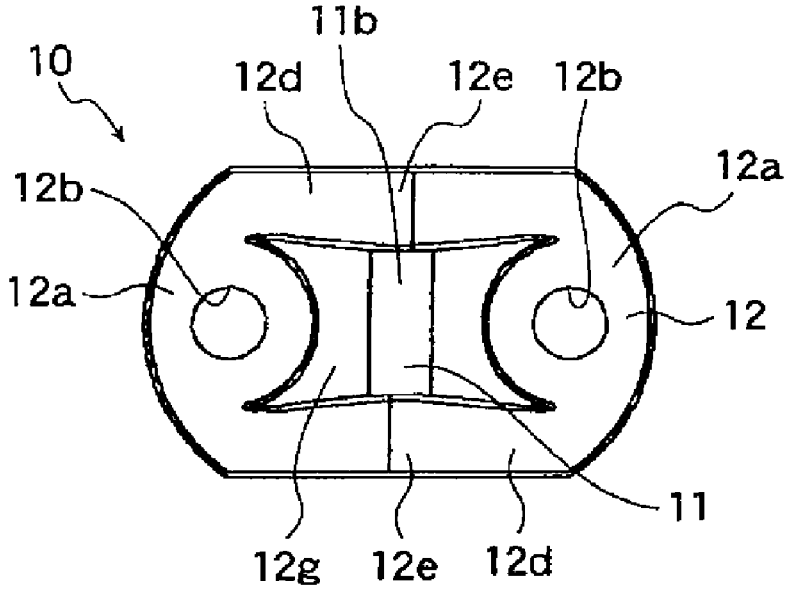
FIG. 11 is a rear view of the embodiment shown in FIG. 7.

The base 12 can be provided with an extension 12*d* that extends from the attachment 12*a*. Preferably, an engagement part 12*e* that is engaged with the base end of the leg 11*a* of the hook 11 is formed at an end of the extension part 12*d*. An inclined or angled surface 12*f* can be formed at an end of the engagement part 12*e* and the inclined surface 12*f* preferably abuts on, and is engaged with, the lower side of the base end of the legs 11*a*, as shown in FIG. 9.

Figure 12:
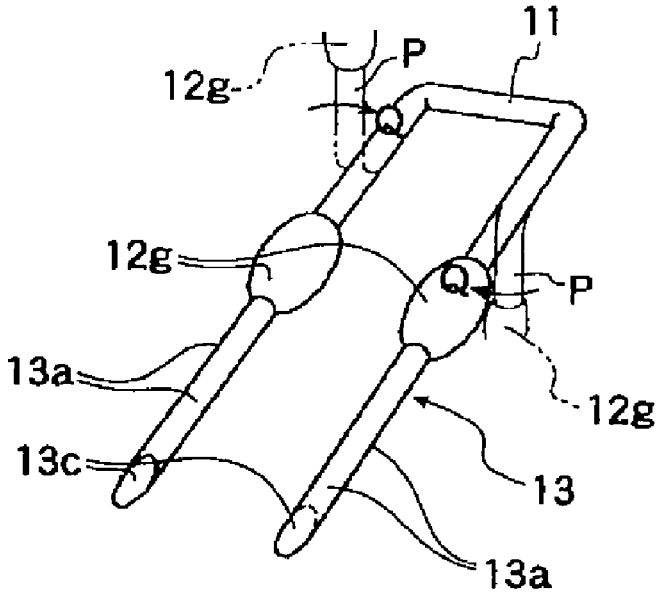
FIG. 12 is a perspective view of the embodiment shown in FIG. 7 illustrating a shaping process used to form at least a portion of the striker.

With reference now to FIG. 12, the illustrated hook 11 can be formed by bending a predetermined length of a metal rod member 13 into a generally U-shaped configuration (e.g., a generally gate shaped configuration). A pair of bulges 12*g*, which extend outward more than other portions of the rod member 13, can be formed at predetermined positions along the rod-shaped sections 13*a* such that, when the rod member 13 is formed into the generally U-shaped configuration, one bulge 12*g* is positioned on each leg of the generally U-shaped configuration.

Next, the rod-shaped sections 13*a* preferably are bent in the middle at approximately right angles in opposite directions from one another, as shown in a chain double-dashed lines P.

In other words, one of the legs defined by one of the rod-shaped sections 13*a* is bent upward while the other is bent downwards from a plane defined by the two sections 13*a* and the bight defined between the two sections 13*a*. Subsequently, a folded end section 13*c* is further folded back on a plane in a direction of an arrow Q such that an inclined surface 13*d* of the end section 13*c* abuts on the base end (i.e., the bent section) of the leg 11*a* to form a loop. In some configurations, the portions remaining from the bends shown in double-dashed lines P are bent two more times such that a C-shape or U-shape is formed (e.g., a configuration that corresponds to the two sides shown in FIG. 11) with the bulges 12*g* being at the center of these shaped portions.

Next, the flat-shaped attachment 12*a* is formed by pressing (compressing) the end section 13*c* in a vertical direction, which results in the top and bottom surfaces, including the bulges 16*g*, being formed into a generally planar shape. Then, the illustrated engagement fitting 10 can be completed by drilling a bolt hole 12*b* in each of the attachments 12*a*.

In some configurations, the inclined surface 12*f* of the base 12 and the leg 11*a* can be bonded together to reduce the likelihood of detachment. In some of these configuration, the bonding can be performed by welding, such as by electric welding, as desired. Moreover, while adding additional machining operations and steps, the flat attachment 12*a* may be finished with cutting or grinding, as desired.

The illustrated engagement fitting 10 can have an improved strength at the base 12 by abutting the inclined surfaces 12*f* of the base 12 on the leg 11*a* to form a consecutive loop. In addition, because a relatively large opening 12*g* (e.g., a weight reducing hole) is formed in the center of the base 12, the weight can be reduced despite the shape, the outline of which is relatively large. Moreover, the relatively large base provides secure mounting for the illustrated engagement fitting 10. In terms of manufacturing, because the base 12 is formed by plastic forming a single rod member, it produces minimal waste materials during processing such that material yields can be improved.

With reference now to FIGS. 13 to 23, another engagement fitting 10 is shown that comprises a hook 11 that is integrally formed with a continuing metal rod member and that is bent into a generally gate shaped configuration. The illustrated engagement fitting 10 also comprises bases 12 that are bent at approximately right angles at the ends of the gate-shaped hook 11 (e.g., the base ends of the gate shaped configuration) and that extend in generally opposite directions from one another relative to a plane generally defined by the gate shaped configuration.

The illustrated hook 11 preferably comprises a pair of legs 11*a* and an engagement pestle 11*b* that extends across these legs 11*a*. The engagement pestle 11*b* preferably extends in parallel with a surface (not shown) of a vehicle body, for instance, to which the engagement fitting 10 will be mounted.

In addition, the base 12 preferably is formed substantially entirely flat and is provided with a pair of attachments 12*a* that are mounted onto other members (e.g., the mounting surface of the vehicle body), which other members are not shown. The attachments 12*a* can have a generally circular configuration and can be formed by flattening spherical bulges 13*b*, as described above. Bolt holes 12*b* can be drilled at the center of the attachments 12*a*.

The base 12 preferably comprises an extension part 12*d* that extends from the attachment 12*a*. The base 12 also preferably comprises an engagement part 12*e* that is engaged with the base end of the leg 11*a*. The engagement part can be formed at a tip of the extension part 12*d*. In some embodiments, a recess 12*h* is formed in the engagement part 12*e* and the base end of the leg 11*a* fits within the recess 12*h*.

Figure 14:
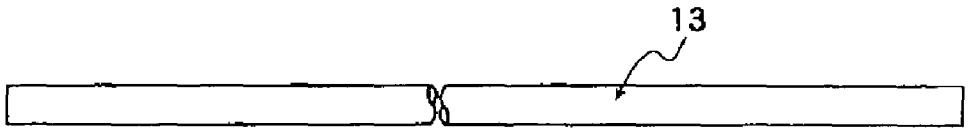
FIG. 14 is a view showing a portion of the engagement fitting during the manufacturing process of the engagement fitting shown in FIG. 13.
Figure 15:
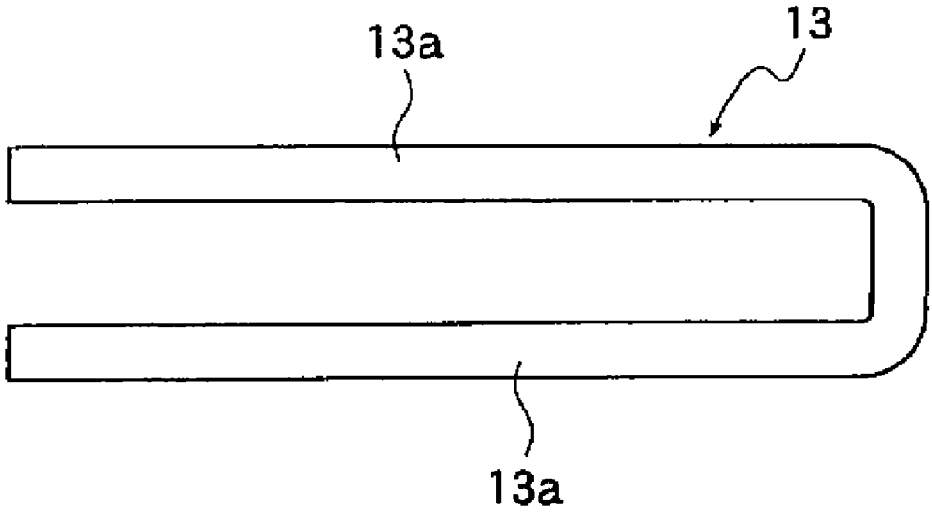
FIG. 15 is a view showing the portion of the engagement fitting during the manufacturing process of the engagement fitting shown in FIG. 13 where the rod member is bent.
Figure 16:
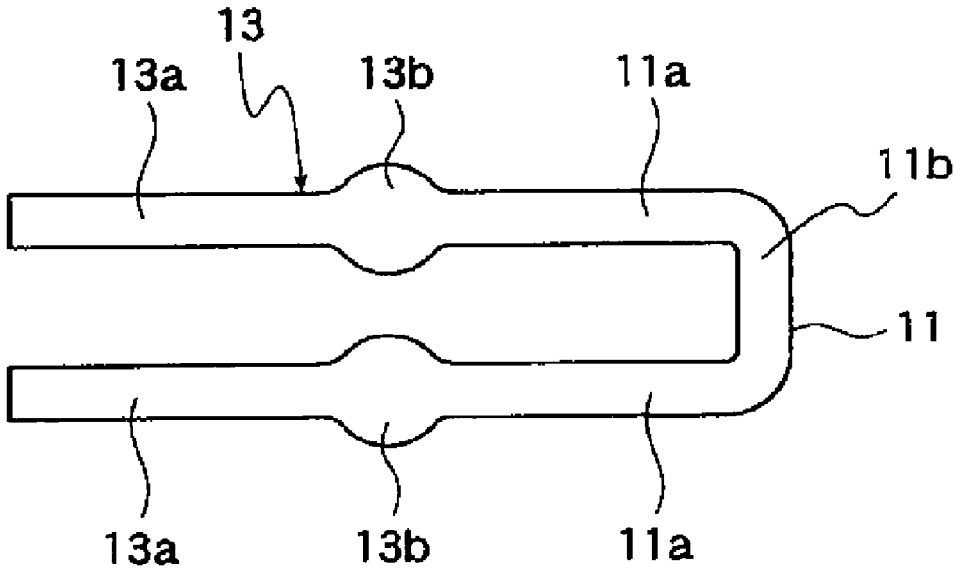
FIG. 16 is a view showing the portion of the engagement fitting during the manufacturing process of the engagement fitting shown in FIG. 13 where bulges are formed in the rod member.

As shown in FIG. 14, a metal rod member 13 can be cut into a predetermined length. Then, as shown in FIG. 15, the hook 11 can be formed by bending the rod member 13 into a generally U-shaped configuration (i.e., a generally gate shaped configuration). A pair of bulges 13*b* then can be formed by forging or the like in predetermined portions on the rod-shaped sections 13*a* of the generally U-shaped member (see FIG. 16).

Figure 13:
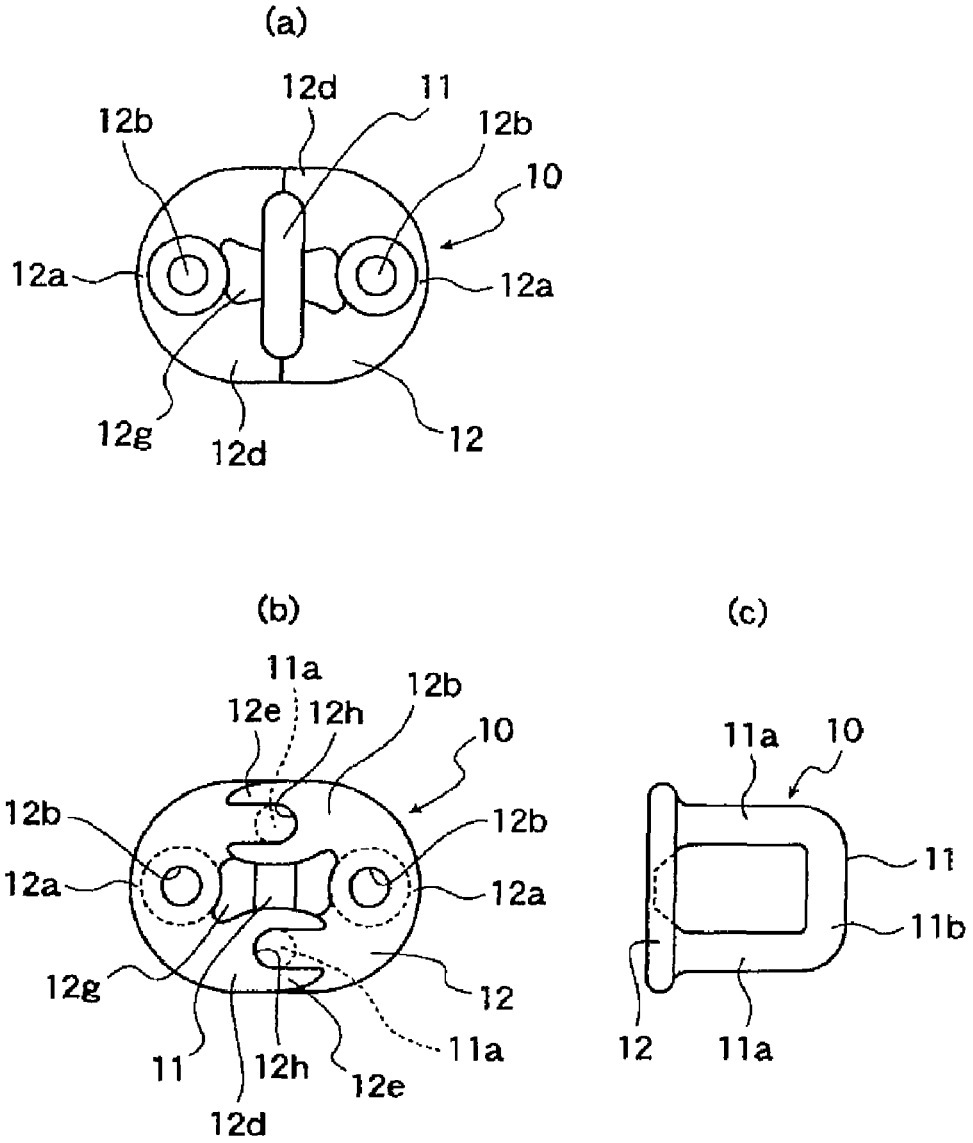
FIG. 13 is a view of an engagement fitting that is arranged and configured in accordance with certain features, aspects and advantages of a third embodiment of the present invention, wherein FIG. 13(*a*) is a plan view, FIG. 13(*b*) is a bottom view, and FIG. 13(*c*) is a right side view of FIG. 13(*b*).
Figure 17:
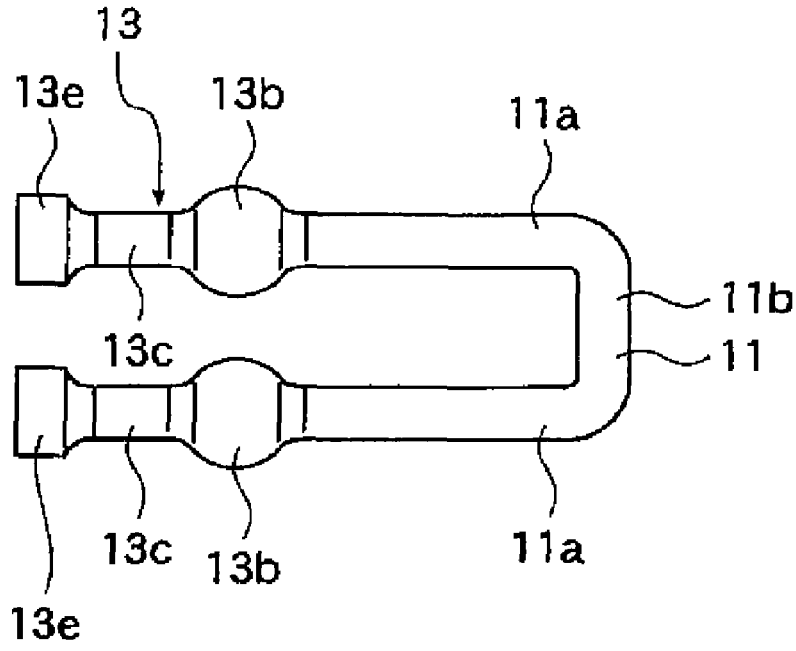
FIG. 17 is a view showing the portion of the engagement fitting during the manufacturing process of the engagement fitting shown in FIG. 13 where bulged portions are formed at tips of the rod member.
Figure 18:
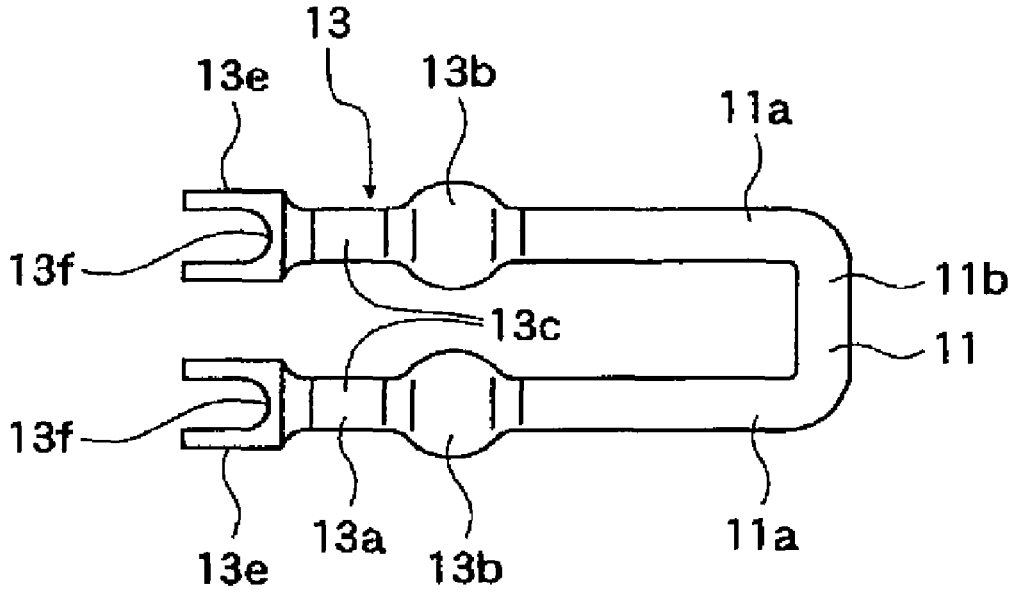
FIG. 18 is a view showing the portion of the engagement fitting during the manufacturing process of the engagement fitting shown in FIG. 13 where the tips of the rod member are formed in a fork shape.
Figure 19:
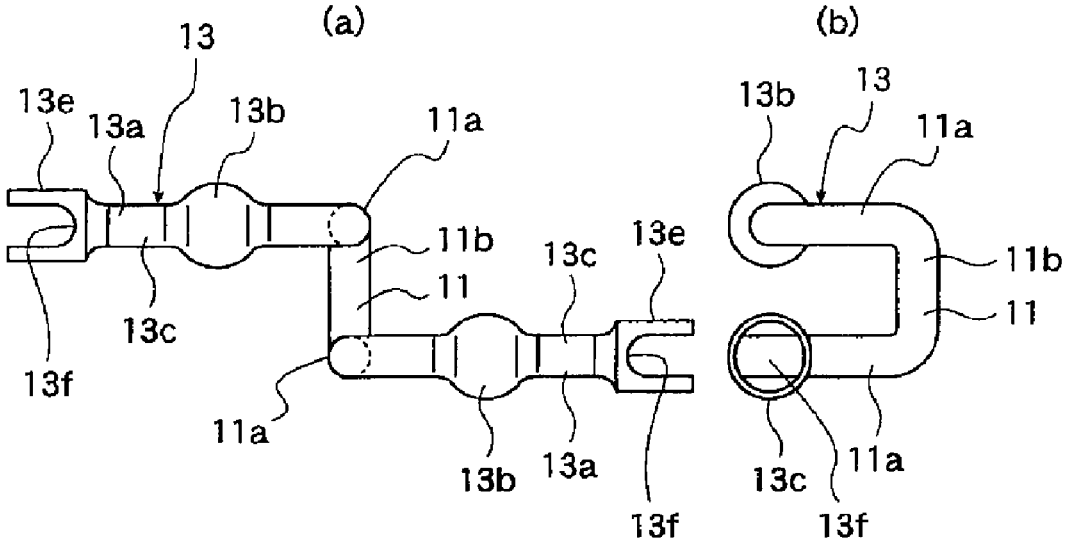
FIG. 19 is a view showing the portion of the engagement fitting during the manufacturing process of the engagement fitting shown in FIG. 13 and in particular showing a first bending state.
Figure 20:
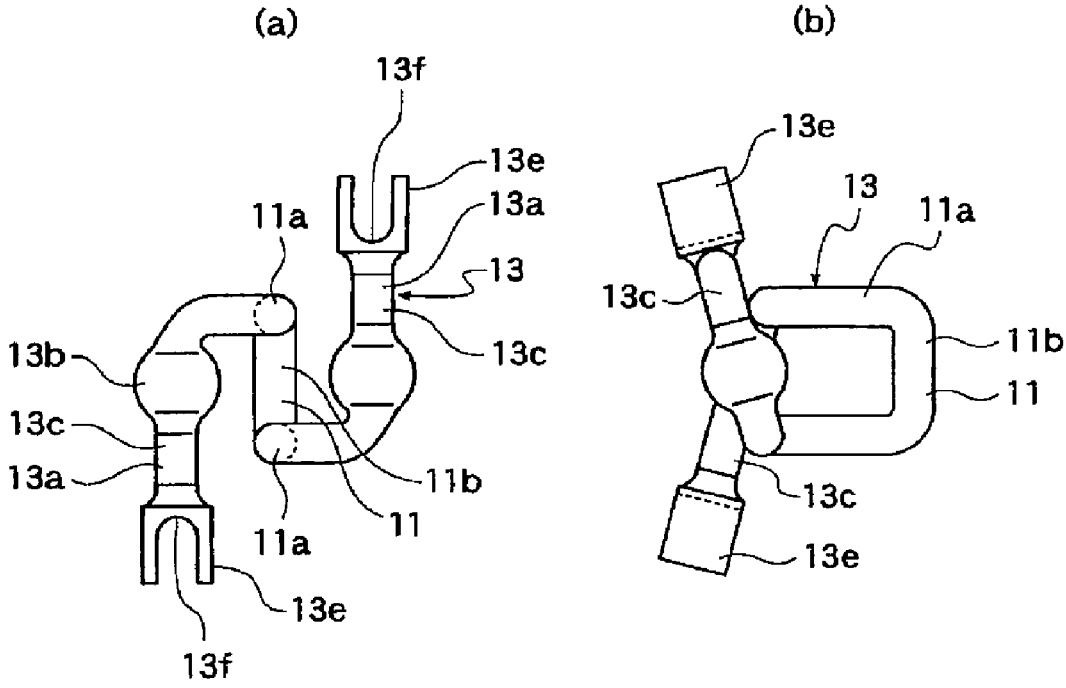
FIG. 20 is a view showing the portion of the engagement fitting during the manufacturing process of the engagement fitting shown in FIG. 13 and in particular showing the second bending state.
Figure 21:
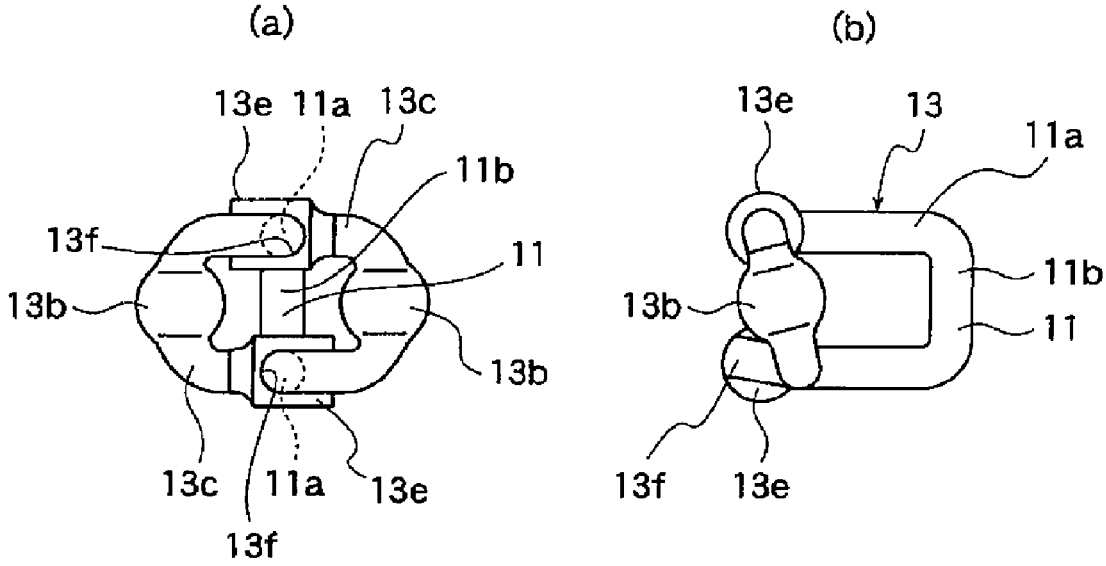
FIG. 21 is a view showing the portion of the engagement fitting during the manufacturing process of the engagement fitting shown in FIG. 13 and in particular showing the third bending state.
Figure 22:
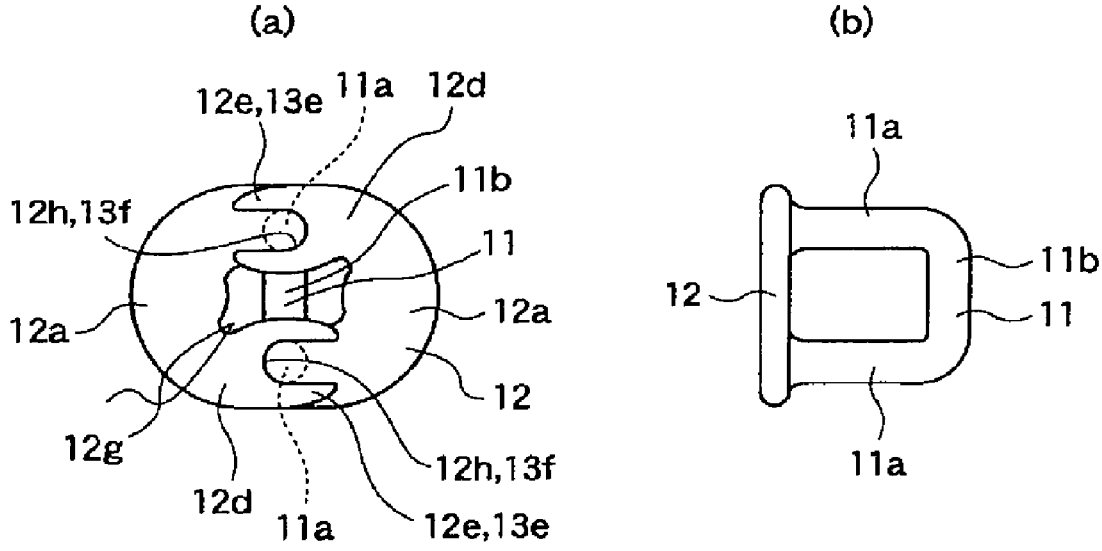
FIG. 22 is a view showing the portion of the engagement fitting during the manufacturing process of the engagement fitting shown in FIG. 13 and in particular showing the base being flattened.
Figure 23:
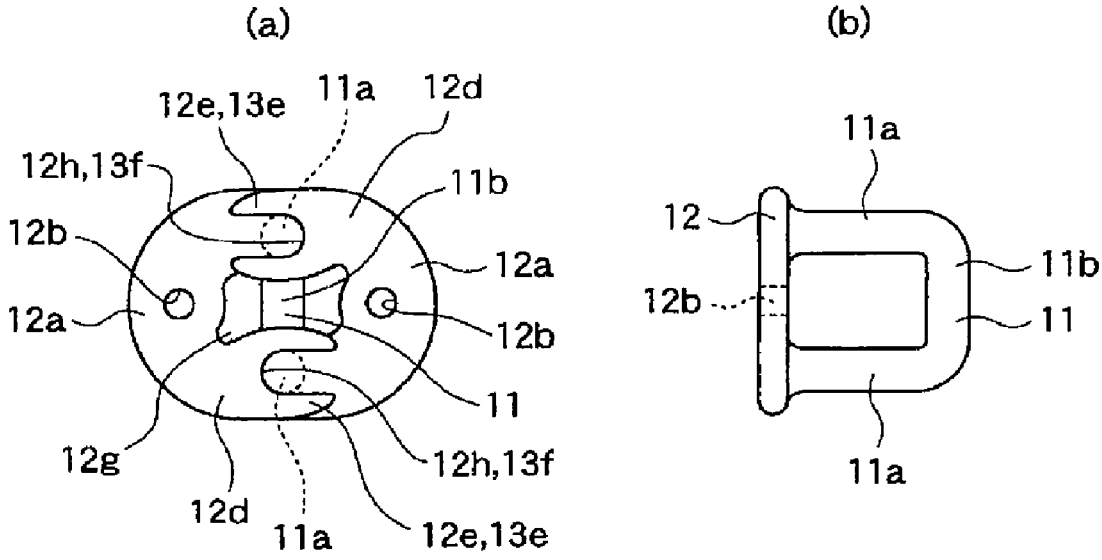
FIG. 23 is a view showing the portion of the engagement fitting during the manufacturing process of the engagement fitting shown in FIG. 13 and in particular showing holes being drilled in the base.

Tips 13*e* of the rod-shaped sections 13*a* then can be forged to be bulged or expanded portions, as shown in FIG. 17. The tips 13*e* can be formed into a fork shape, as shown in FIG. 18. Then, as shown in FIG. 19(*a*) and FIG. 19(*b*), the pair of rod-shaped sections 13*a* can be bent at approximately right angles in opposite directions. The pair of rod-shaped sections 13*a* also can be bent in different directions from the first bending, as shown in FIG. 20, and further, as shown in FIG. 21, the pair of rod-shaped sections 13*a* can be bent once more in order for the fork-shaped recesses 13*f* of the tip ends 13*e* to receive the base ends of the hook legs 11*a*. As shown in FIG. 22, the base 12 then can be formed by forging and then, as shown in FIG. 23, the bolt holes 12*b* can be drilled, as shown in FIG. 13.

As described above, it is possible to cut down the number of parts used to make the engagement fitting 10 by using only a single rod member 13. Moreover, it is possible to strengthen the base 12 by fitting the legs 11*a* into the recesses 12*h*. Also, forming the entire base 12 into a flat shape makes it easier to establish contact with the vehicle mounting surface.

Figure 24:
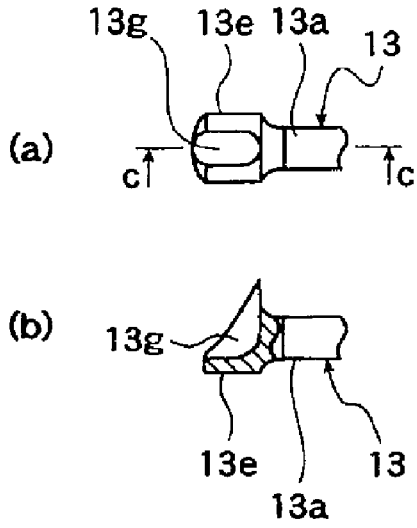
FIG. 24 is a view showing the tips of another engagement fitting that is arranged and configured in accordance with certain features, aspects and advantages of a fourth embodiment of the present invention, with FIG. 24(*a*) being a plan view and FIG. 24(*b*) being a cross sectional view of FIG. 24(*a*) taken along the line c-c.
Figure 25:
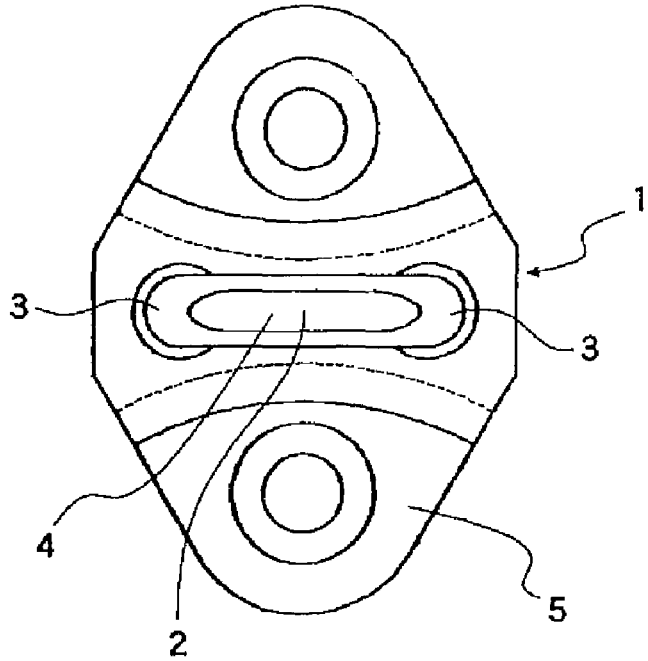
FIG. 25 is a plan view showing a conventional engagement fitting.
Figure 26:
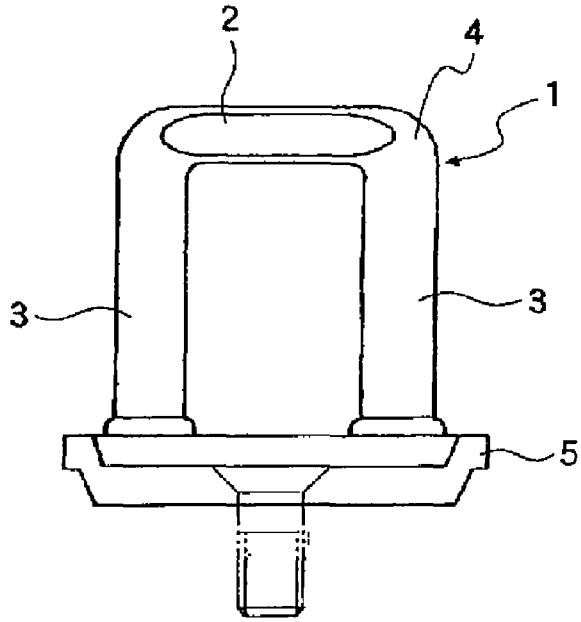
FIG. 26 is a front view showing the conventional engagement fitting.

With reference now to FIG. 24, recesses 13*g* are formed into the base ends of the legs 11*a* by performing the bending processes shown in FIGS. 19, 20, and 21 after forming recesses 13*g* at the tips 13*e*. Afterwards, the entirety of the base 12 is flattened by forging or the like, similar to that shown in FIG. 22. In this manner, the strength of the base 12 can be improved.

Although the present invention has been described in terms of certain embodiments, other embodiments apparent to those of ordinary skill in the art also are within the scope of this invention. Thus, various changes and modifications may be made without departing from the spirit and scope of the invention. For instance, variations on the bends can be made, as desired. In some configurations, the bends and forgoings can be performed in other orders. Moreover, not all of the features, aspects and advantages are necessarily required to practice the present invention. Accordingly, the scope of the present invention is intended to be defined only by the claims that follow.

What is claimed is:

1. An engagement fitting consisted of a hook and a base that are integrally formed with a single metal rod member, the hook having a generally u-shaped configuration comprising a first and a second leg, the base having first and second base portions, each extending at an approximately right angle from a respective base end of the legs, the generally u-shaped hook being positioned between the base portions, each base portion having an engagement end and a generally flat attachment portion positioned between the engagement end and the respective base end of the legs, each attachment portion comprising a mounting hole, each mounting hole comprising a central axis and an imaginary plane that is defined by the central axes substantially bisecting the u-shaped hook, the engagement end of the first base portion is configured to receive the base end of the second leg and the engagement end of the second base portion is configured to receive the base end of the first leg.

2. The engagement fitting of claim 1, wherein the bottom of the base comprises a roughened surface.

3. The engagement fitting of claim 1, wherein the u-shaped hook defines a second imaginary plane that separates the pair of base portions such that a first base portion of the pair of base portions is separated from a second base portion of the pair of base portions by the second imaginary plane.

4. The engagement fitting of claim 1, wherein an engagement pestle extends between the pair of spaced legs and the imaginary plane that is defined by the central axes extends at a right angle through the engagement pestle.

* * * * *